US011896089B2

(12) United States Patent
Yang

(10) Patent No.: US 11,896,089 B2
(45) Date of Patent: Feb. 13, 2024

(54) TEST FIXTURE FOR SOLES

(71) Applicant: Teng-Jen Yang, Taichung (TW)

(72) Inventor: Teng-Jen Yang, Taichung (TW)

( * ) Notice: Subject to any disclaimer, the term of this patent is extended or adjusted under 35 U.S.C. 154(b) by 151 days.

(21) Appl. No.: 17/574,490

(22) Filed: Jan. 12, 2022

(65) Prior Publication Data

US 2023/0218045 A1 Jul. 13, 2023

(51) Int. Cl.
*A43D 1/08* (2006.01)

(52) U.S. Cl.
CPC ..... *A43D 1/08* (2013.01)

(58) Field of Classification Search
CPC ..... A43D 1/04; A43D 1/06; A43D 1/08
USPC ..... 12/123
See application file for complete search history.

(56) References Cited

U.S. PATENT DOCUMENTS 2,793,439 A * 5/1957 Simpson ..... A43D 1/027 33/3 B
6,192,593 B1 * 2/2001 Borchers ..... A43D 1/06 33/542.1
10,470,526 B1 * 11/2019 Vladimirov ..... A43D 1/06
2015/0201709 A1 * 7/2015 Jurkovic ..... A43D 25/06 702/155
2020/0069000 A1 * 3/2020 Bishoff ..... A43D 1/027

* cited by examiner

*Primary Examiner* — Timothy K Trieu
(74) *Attorney, Agent, or Firm* — Bruce Stone LLP; Joseph A. Bruce

(57) ABSTRACT

A test fixture for soles includes a sole member, a heel cushion, a sole connector, a ring-shaped airbag, a torque connector, and an attaching assembly. The heel cushion is disposed on a heel section of the sole member and sandwiched in between the sole member and the sole connector. The airbag is disposed on the sole connector, and the torque connector is inserted in the airbag. The torque connector includes one end connected to the sole connector, and one opposite end connected to the attaching assembly disposed on the airbag.

13 Claims, 5 Drawing Sheets

TEST FIXTURE FOR SOLES

BACKGROUND

Field of the Invention

The present invention relates to a test fixture, and more particularly to a test fixture for soles with simulation effect.

Description of Related Art

Most of the existing shoe sole testing mechanisms use testing machines to test the properties of the test soles (such as but not limited to wear resistance, toughness or structural strength, etc.) by directly and repeatedly pressing, beating, pulling or rubbing the test soles). However, this traditional test method is designed not by imitating the user's actual use conditions, so it is relatively impossible to test the test soles for the properties they will express in actual use.

In order to test the test sole for the properties it will express in actual use, another test method was proposed on the market. In the test method, a real person is appointed to directly put on a shoe sample, to which the test sole is arranged, and perform various actions; and the properties of the test sole are then analyzed by observing the condition of the test sole after a long period of actual use. However, this test method relying upon real persons is not only expensive in personnel costs, but also time-consuming due to human limitations, and is also prone to interruption or suspension of the testing process due to other force majeure factors (such as epidemic situations).

SUMMARY

One objective of the present invention is to provide a test fixture for soles with simulation effect, and the test fixture is capable of simulating the state of a real person performing various actions after putting on shoes with such soles.

A test fixture for soles in accordance with an embodiment of the invention includes: a sole member including a heel section; a heel cushion configured to be disposed on the heel section of the sole member; a sole connector configured to be connected to the sole member so that the heel cushion is located between the sole member and the sole connector; an airbag having a ring shape and configured to be disposed on the sole connector; a torque connector configured to be surrounded by the airbag, and one of two ends of the torque connector being configured to be connected to the sole connector; and an attaching assembly configured to be disposed on the airbag and connected to the other one of the two opposite ends of the torque connector.

In some embodiment, the sole member further includes a toe section and a plurality of simulated toes on the toe section.

In some embodiment, the torque connector includes an elastic block and two connecting portions respectively located at two opposite ends of the elastic block, and the two connecting portions of the torque connector are configured to be connected to the sole connector and the attaching assembly, respectively.

In some embodiment, the attaching assembly includes a carrier, and at least one of the sole connector and the carrier includes a groove for accommodating the elastic block of the torque connector.

In some embodiment, at least one annular groove is provided on a side surface of the elastic block.

In some embodiment, the heel cushion includes a comb structure.

In some embodiment, the sole connector includes a groove to accommodate a part of the heel cushion and restrict movement of the heel cushion.

In some embodiment, the attaching assembly includes a carrier, and at least one of the sole connector and the carrier includes an annular groove to accommodate a part of the airbag and restrict movement of the airbag.

In some embodiment, the sole member includes a plurality of spikes or spike holes.

In some embodiment, the heel cushion and at least a part of the sole member are made of elastic material.

In some embodiment, at least one of the sole connector and the carrier is made of metal.

In some embodiment, the attaching assembly includes a carrier and a locking member, the carrier is configured to be disposed on the airbag and surround the other end of the torque connector, and the locking member is configured to lock the other end of the torque connector.

In some embodiment, the sole member further includes a container to accommodate the heel cushion and at least a part of the sole connector.

In some embodiment, the container extends from a mi-foot section of the sole member to the heel section.

In some embodiment, the sole member further includes a positioning portion, the sole connector includes a positioning portion, and the positioning portion of the sole member is configured to contact the positioning portion of the sole connector, thereby restricting horizontal displacement of the sole connector relative to the sole member.

In some embodiment, the sole member further includes a limiting portion, the sole connector includes a limiting portion, and the limiting portion of the sole member is configured to contact the limiting portion of the sole connector, thereby restricting vertical displacement of the sole connector relative to the sole member.

Therefore, the test fixture for soles provided by the present invention can simulate the cushioning ability of human heel muscles through the heel cushion, can simulate the rotation flexibility and supporting capacity of human ankle by the torsion connector, and can simulate the shock absorption and cushioning abilities of human ankle by the airbag. In this way, the test fixture for soles provided by the present invention can simulate the condition of the test soles in actual use, so that the test results during the test may better fit the properties of the test soles in actual use.

BRIEF DESCRIPTION OF THE DRAWINGS

After studying the detailed description in conjunction with the following drawings, other aspects and advantages of the present invention will be discovered.

DETAILED DESCRIPTION

Figure 1:
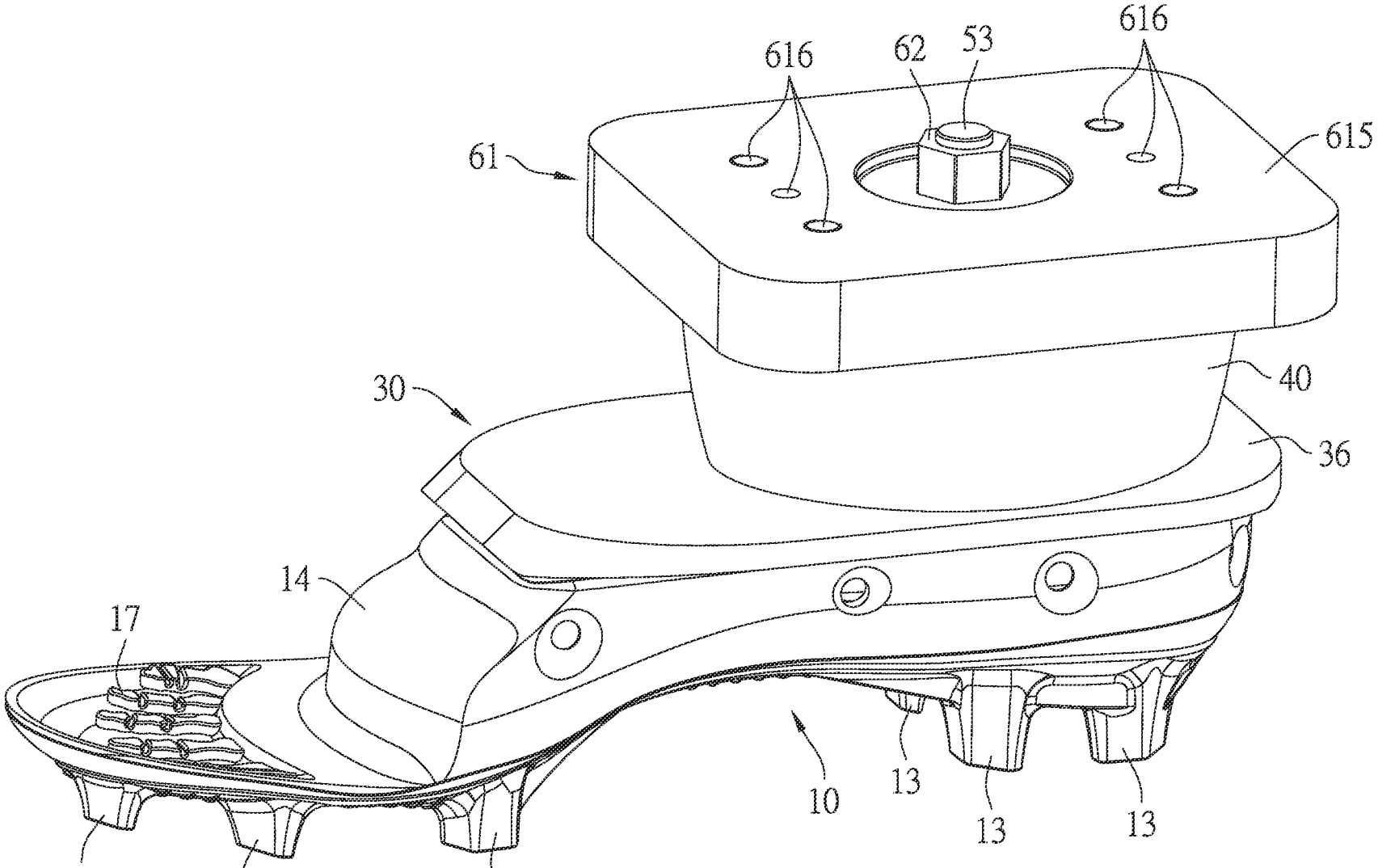
FIG. 1 is a schematic diagram of a test fixture for soles according to an embodiment of the present invention.

In the following detailed description, many specific details are explained in order to provide a thorough understanding of the present invention. However, those of ordinary skill in the art will understand that the present invention can be practiced without these specific details. In other cases, well-known elements have not been described in detail so as not to obscure the present invention.

A test fixture provided by the present invention is suitable for testing the structure and material of shoe soles, such as but not limited to the soles of football shoes, of various shoes. In order to explain the spirit of the present invention concisely, the following description will take a test of the bottom structure and material of the sole of a football shoe as an example. Please refer to FIGS. 1 to 4 illustrating a test fixture for soles according to an embodiment of the present invention, and the test fixture includes a sole member 10, a heel cushion 20, a sole connector 30, an airbag 40, a torque connector 50 and an attaching assembly 60.

Figure 3:
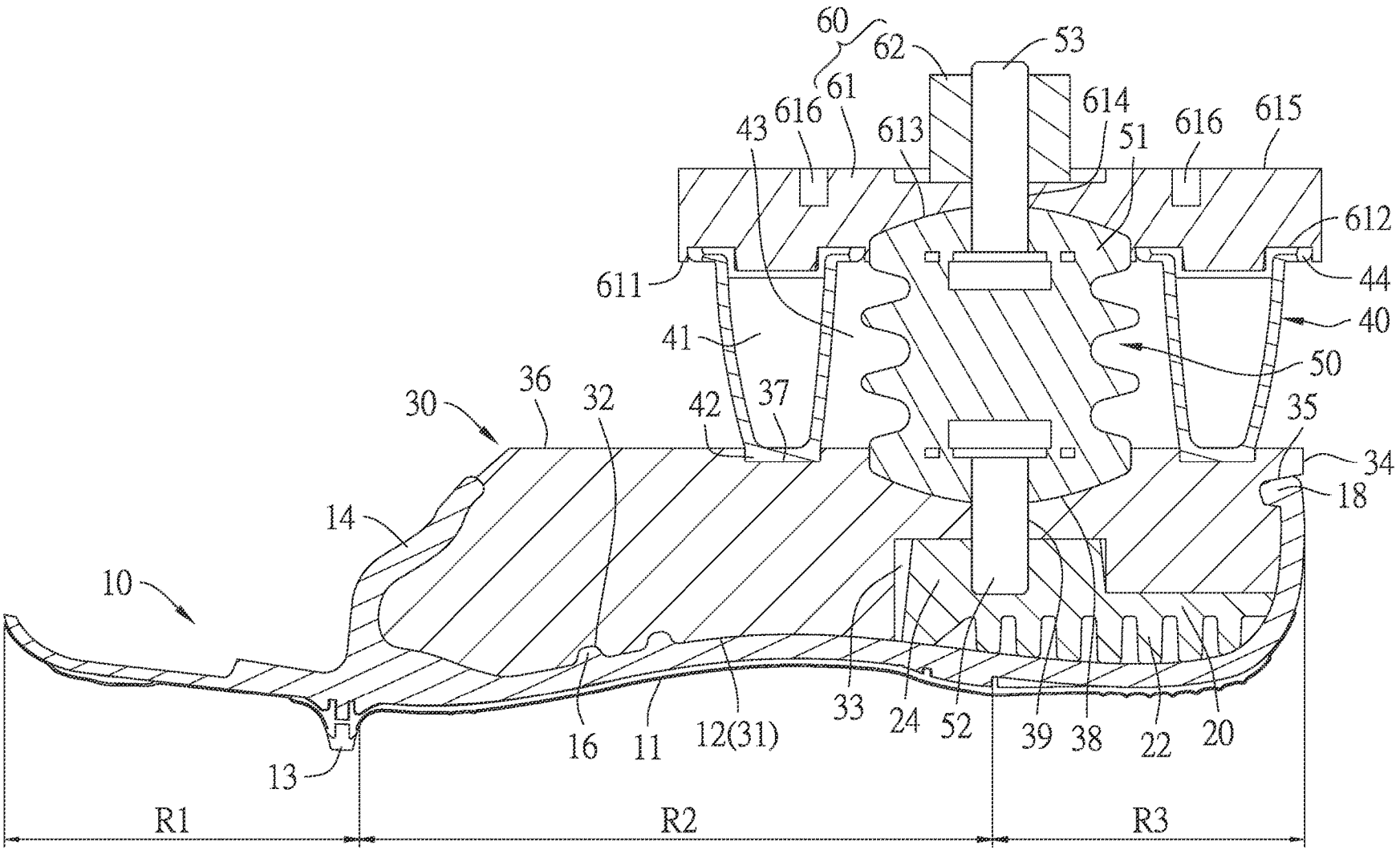
FIG. 3 is a schematic cross-sectional view of FIG. 1.

The sole member 10 is an object under test with a bottom structure and material to be applied to the sole of a football shoe, and includes a toe section R1, a mid-foot section R2, and a heel section R3. These three sections correspond to the toes, forefoot and heel of a human foot, as shown in FIG. 3. A plurality of spikes 13 are arranged on a surface 11 of the sole member 10, and these spikes 13 are distributed in the toe section R1 and the heel section R3 of the sole member 10. A side wall 14 protrudes from another surface 12 of the sole member 10 opposite to the surface 11. The side wall 14 is annular and surrounds the mid-foot section R2 and the heel section R3 of the sole member 10 to form a container 15 together with the surface 12. At least one positioning portion 16 is provided on the bottom (that is, the surface 12 located in the container 15) of the container 15. The surface 12 of the sole member 10 is further provided with a plurality of simulated toes 17 on the toe section R1, so that a simulation of the state of a person's toes pressing on the sole can be carried out to better fit the real condition of the sole in actual use. In addition, the side wall 14 of the sole member 10 is provided with a limiting portion 18. The material of a part or all of the sole member 10 may be, for example, but not limited to, an elastic material, and the elastic material may be, for example, but not limited to, an existing or known elastic material applied to shoe soles.

The heel cushion 20 is disposed on the heel section R3 in the container 15. A comb structure 22 is provided on a surface 21 of the heel cushion 20 facing the sole member 10. A bump 24 is provided on another surface 23 of the heel cushion 20 opposite to the surface 21 and away from the sole member 10. The heel cushion 20 can be manufactured by, for example, but not limited to, injection molding, and the heel cushion 20 is made of an elastic material, such as but not limited to thermoplastic polyurethane (TPU).

The sole connector 30 can be placed in the container 15 and surrounded by the side wall 14 of the sole member 10, so that the horizontal movement of the sole connector 30 relative to the sole member 10 is restricted. In this embodiment, a positioning portion 32 may be provided on a surface 31 of the sole connector 30 facing the sole member 10. The shape and number of positioning portions 32 can match the positioning portion 16 of the sole member 10. The sole connector 30 is provided with a groove 33 on the surface 31. A side surface 34 of the sole connector is also provided with a limiting portion 35, and the shape and number of limiting portions 35 match the shape and number of limiting portions 18 of the sole member 10. The material of the sole connector 30 includes, for example, but not limited to metal. When the heel cushion 20 and the sole connector 30 are assembled to the sole member 10, the heel cushion 20 is located between the sole member 10 and the sole connector 30, and the comb structure 22 of the heel cushion 20 abuts against the surface 12 of the sole member 10, thereby simulating the cushioning function of the human heel muscle; the bump 24 of the heel cushion 20 can be inserted into the groove 33 of the sole connector 30 to restrict horizontal movement of the heel cushion 20 relative to the sole connector 30; the positioning portion 32 of the sole connector 30 is also connected (contacted or engaged) with the positioning portion 16 of the sole member 10 to prevent horizontal movement of the sole connector 30 relative to the sole member 10; and the limiting portion 35 of the sole connector 30 is connected (contacted or engaged) with the limiting portion 18 of the sole member 10 to restrict the sole connector 30 from moving vertically relative to the sole member 10.

The airbag 40 may have a ring shape and include an air chamber 41. The airbag 40 may be provided on the sole connector 30. For example, an annular groove 37 may be further provided on another surface 36 of the sole connector 30 opposite to the surface 31, so that one end 42 of the airbag 40 can be placed in the annular groove 37 to limit or prevent the airbag 40 from moving horizontally with respect to the sole connector 30.

The torque connector 50 includes an elastic block 51 and two connecting portions 52 and 53 respectively located at two opposite ends of the elastic block 51. At least one annular groove 512 is provided on a side surface 511 of the elastic block 51 to increase the flexibility, which consequently enhances the torque resistance of the torque connector 50. The torque connector 50 can be manufactured by, for example, but not limited to, embedding washers and screws into a material, for example but not limited to, TPU, and then injection molding the material.

Figure 2:
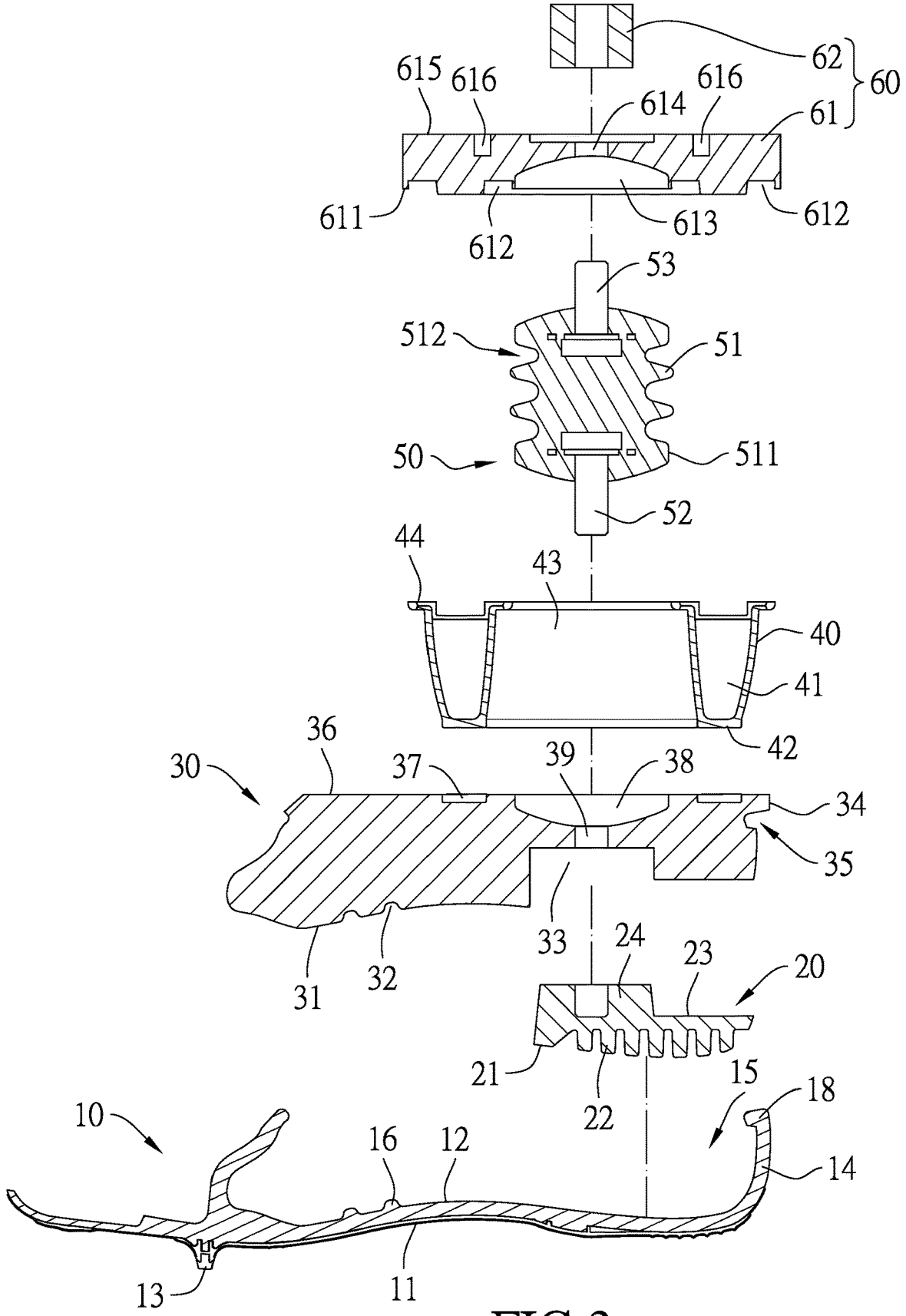
FIG. 2 is an exploded view of a test fixture for soles provided in a cross-sectional view according to an embodiment of the present invention.

The torque connector 50 can be sleeved with the ring-shaped airbag 40, and can be connected to the sole connector 30. For example, the surface 36 of the sole connector 30 may be further provided with a groove 38 and a fixing hole 39 located in the groove 38, and the annular groove 37 surrounds the groove 38 and the fixing hole 39, as shown in FIG. 2. Therefore, when the torque connector 50 is assembled to the sole connector 30, the connecting portion 52 of the torque connector 50 can be inserted into the fixing hole 39 of the sole connector 30 after passing through a passage 43 of the airbag 40, so that the elastic block 51 of the torque connector 50 can be surrounded by the airbag 40, and one end of the elastic block 51 can be placed in the groove 38 of the sole connector 30. The positions of the airbag 40 and the torque connector 50 can correspond to the position of the human ankle, whereby the airbag 40 can be used to simulate the shock absorption ability of the ankle when the foot is moving fast, and the torque connector 50 can be used to simulate the rotation flexibility and supporting capacity of the human ankle.

The attaching assembly 60 includes a carrier 61 and a locking member 62. The carrier 61 can be made of, for example, but not limited to, metal. The carrier 61 is disposed on the airbag 40 and connected to the connecting portion 53 of the torque connector 50. For example, a surface 611 of the carrier 61 facing the airbag 40 is provided with at least one annular groove 612 (such as but not limited to two annular grooves), a groove 613, and a fixing hole 614 located in the groove 613. The annular groove 612 surrounds the groove 613, and the position, shape, amount, and size of the annular groove 612 can be determined according to the position, shape, and size of another end 44 of the airbag 40 opposite to the end 42. The type of the locking member 62 can be matched with the type of the connecting portion 53; and for example, when the connecting portion 53 is a screw, the locking member 62 can be a nut. When the end 44 of the airbag 40 is placed in the annular groove 612 of the carrier 61, and the connecting portion 53 of the torque connector 50 is inserted into the fixing hole 614 of the carrier 61, the elastic block 51 of the torque connector 50 enters the groove 613 of the carrier 61, and the airbag 40 and the torque connector are located between the carrier 61 and the sole connector 30. At this time, the locking member 62 can be used to lock the connecting portion 53 protruding out of a surface 615 (opposite to the surface 611) of the carrier 61 to restrict the airbag 40 and the torque connector 50 from moving vertically relative to the sole member 10.

In addition, one or more fixing holes 616 can be provided on the surface 615 of the carrier 61 as required, as shown in FIGS. 1, 2 and 3, so that the entire test fixture can be detachably assembled to a robot to perform subsequent sole testing procedures (such as but not limited to the test of the wear resistance of the sole, of the strength of the spikes, or of the comparison of the properties of different sole materials, etc).

Figure 4:
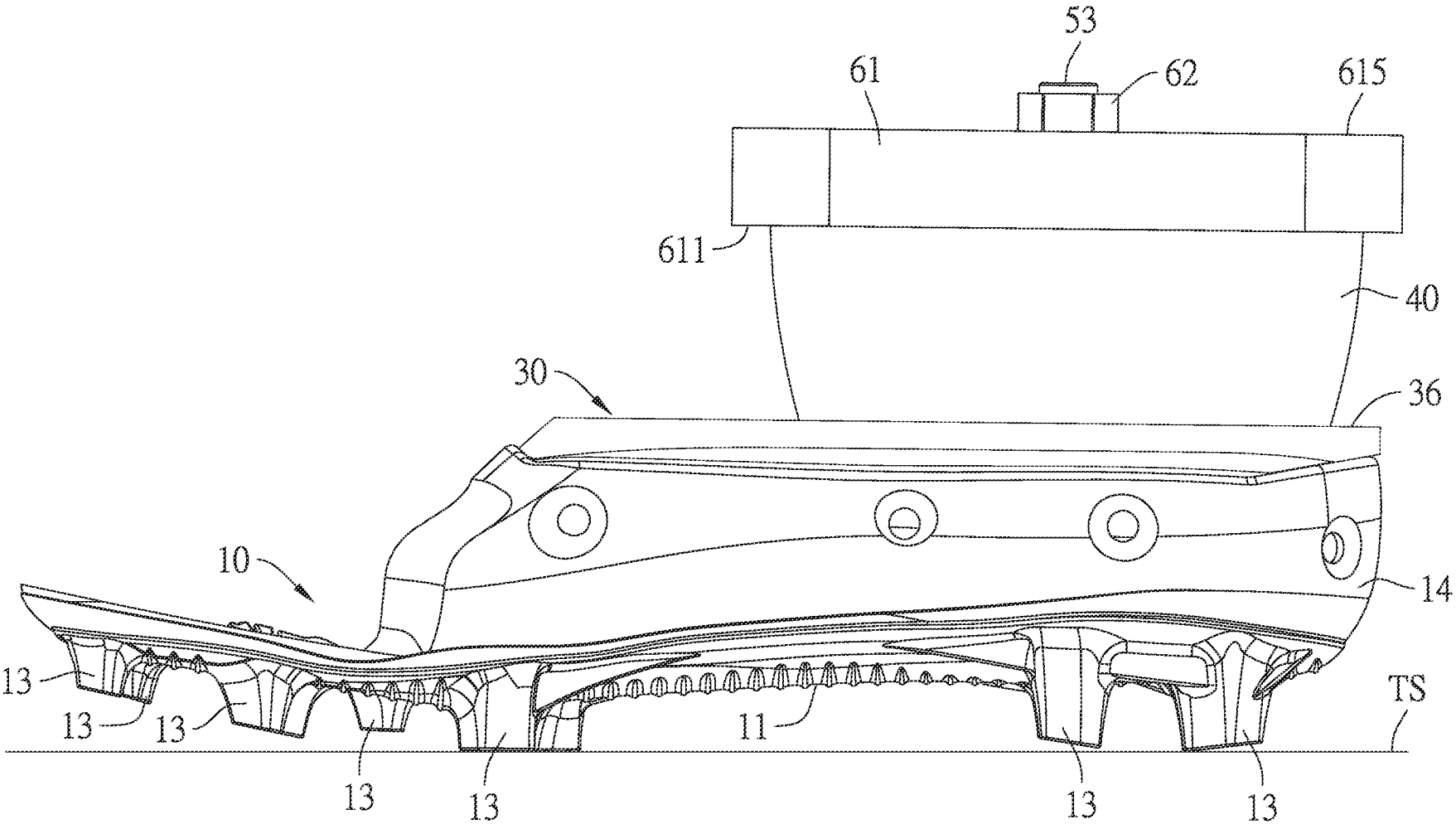
FIG. 4 is a schematic diagram of a test fixture for soles on a test platform according to an embodiment of the present invention.
Figure 5:
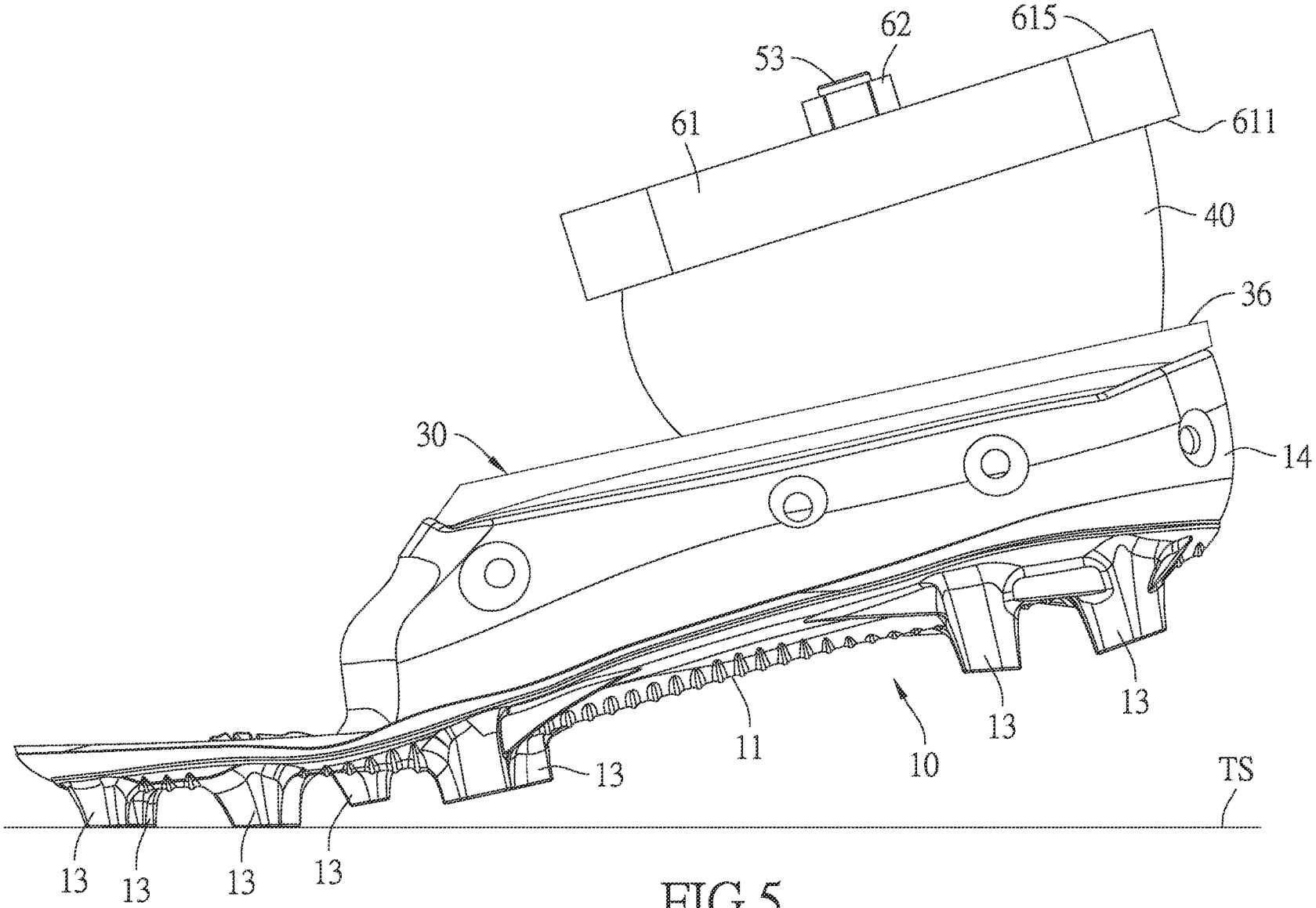
FIG. 5 is a schematic diagram of a test fixture for soles contacting a test platform according to an embodiment of the present invention, to present a state where the airbag is deformed when being pressed.

During the shoe sole test procedure, as shown in FIG. 4, the robot moves the test fixture of the present invention to a test platform, and drives the test fixture to repeatedly move relative to the test surface TS of the test platform to simulate the state of a real person performing various actions, such as but not limited to walking, running, jumping, kicking or tackling, after putting on the soccer shoe whose sole is made of the material of the sole member 10 and which has the structure on the surface 11. The material of the test surface TS of the test platform may be, for example, but not limited to, turf. During the relative movement, when the sole member 10 of the test fixture touches the test surface TS of the test platform, the airbag 40 is deformed due to the force exerted on the test fixture by the robot arm, and the reaction force from the test surface TS, as shown in FIG. 5, so as to accurately simulate the cushioning ability expressed by the human ankle when the foot lands on the ground.

Although the above-mentioned various embodiments are described with an example applied to football shoes, the present invention is not limited to this implementation. In fact, the structure (i.e., the bottom structure) on the surface 11 of the sole member 10 can be designed according to the type of shoes to be used in practice. For example, if it is applied to jogging shoes, the spikes 13 on the bottom structure of the sole member 10 can be omitted; and if it is applied to track and field spiked shoes, the bottom structure of the sole member 10 can be changed to be provided with spike holes into which the spikes can be inserted.

Although the sole member 10 in the foregoing embodiments is provided with a side wall 14 so that the sole connector 30 can be connected to the sole member 10 by inserting into the container 15 of the sole member 10, the present invention is not limited to this implementation. In other embodiments, the side wall can be removed from the sole member, and the sole member and the sole connector can be respectively provided with corresponding engaging structures, so that the sole connector can be connected to the sole member. Alternatively, the sole member can be screwed to the sole connector.

Although the present invention is disclosed in the foregoing embodiments, these embodiments are not intended to limit the present invention. Without departing from the spirit and scope of the present invention, all modifications and combinations of various implementation modes are within the scope of patent protection of the present invention. For the scope of protection defined by the present invention, please refer to the attached claims.

What is claimed is:

1. A test fixture for soles comprising:

a sole member including a heel section;

a heel cushion configured to be disposed on the heel section of the sole member;

a sole connector configured to be connected to the sole member so that the heel cushion is located between the sole member and the sole connector;

an airbag having a ring shape and configured to be disposed on the sole connector;

a torque connector configured to be surrounded by the airbag, and one of two opposite ends of the torque connector being configured to be connected to the sole connector; and an attaching assembly configured to be disposed on the airbag and connected to the other one of the two opposite ends of the torque connector, and the attaching assembly including a carrier configured to be disposed on the airbag and surround the other one of the two opposite ends of the torque connector.

2. The test fixture as claimed in claim 1, wherein the sole member further includes a toe section and a plurality of simulated toes on the toe section.

3. The test fixture as claimed in claim 1, wherein the torque connector includes an elastic block and two connecting portions respectively located at two opposite ends of the elastic block, and the two connecting portions of the torque connector are configured to be connected to the sole connector and the attaching assembly, respectively.

4. The test fixture as claimed in claim 3, wherein at least one of the sole connector and the carrier includes a groove for accommodating the elastic block of the torque connector.

5. The test fixture as claimed in claim 3, wherein at least one annular groove is provided on a side surface of the elastic block.

6. The test fixture as claimed in claim 1, wherein the heel cushion includes a comb structure.

7. The test fixture as claimed in claim 1, wherein the sole connector includes a groove to accommodate a part of the heel cushion and restrict movement of the heel cushion.

8. The test fixture as claimed in claim 1, wherein at least one of the sole connector and the carrier includes an annular groove to accommodate a part of the airbag and restrict movement of the airbag.

9. The test fixture as claimed in claim 1, wherein the sole member includes a plurality of spikes or spike holes.

10. The test fixture as claimed in claim 1, wherein the attaching assembly further includes a locking member configured to lock the other one of the two opposite ends of the torque connector.

11. The test fixture as claimed in claim 1, wherein the sole member further includes a container to accommodate the heel cushion and at least a part of the sole connector.

12. The test fixture as claimed in claim 1, wherein the sole member further includes a positioning portion, the sole connector includes a positioning portion, and the positioning portion of the sole member is configured to contact the positioning portion of the sole connector, thereby restricting horizontal displacement of the sole connector relative to the sole member.

13. The test fixture as claimed in claim 1, wherein the sole member further includes a limiting portion, the sole connector includes a limiting portion, and the limiting portion of the sole member is configured to contact the limiting portion of the sole connector, thereby restricting vertical displacement of the sole connector relative to the sole member.

* * * * *